US006408473B1

(12) United States Patent
Kessler

(10) Patent No.: US 6,408,473 B1
(45) Date of Patent: Jun. 25, 2002

(54) TOOTH BRUSH WITH ELASTICALLY ARTICULATED REPLACEABLE HEAD

(75) Inventor: Kurt Kessler, Munich (DE)

(73) Assignee: SmithKline Beecham GmbH & Co. KG, Buehl (DE)

( * ) Notice: Subject to any disclaimer, the term of this patent is extended or adjusted under 35 U.S.C. 154(b) by 0 days.

(21) Appl. No.: 09/142,393

(22) PCT Filed: Mar. 4, 1997

(86) PCT No.: PCT/EP97/01071

§ 371 (c)(1),
(2), (4) Date: May 24, 1999

(87) PCT Pub. No.: WO97/32502

PCT Pub. Date: Sep. 12, 1997

(30) Foreign Application Priority Data

Mar. 4, 1996 (DE) ..... 196 08 226

(51) Int. Cl.[7] ..... A46B 7/06; A46B 7/04

(52) U.S. Cl. ..... 15/104.94; 15/172; 15/167.1; 15/176.4; 15/185; 132/309; 40/314; 40/913

(58) Field of Search ..... 15/172, 167.1, 15/167.2, 176.1, 176.4, 176.5, 144.1, 104.93, 104.94, 145, 185; 132/309, 321, 308, 310; 40/913, 447, 314

(56) References Cited

U.S. PATENT DOCUMENTS

| | | | | | |
|---|---|---|---|---|---|
| 541,727 | A | * | 6/1895 | Dennis | 15/172 |
| 1,172,109 | A | * | 2/1916 | Cammach | 15/172 |
| 2,395,245 | A | * | 2/1946 | Booharin | 15/172 |
| 2,749,567 | A | * | 6/1956 | Krueger | 15/172 |
| 3,398,421 | A | * | 8/1968 | Rashbaum | 15/172 |
| 3,604,044 | A | * | 9/1971 | Johnson | 15/172 |
| 5,127,415 | A | * | 7/1992 | Preciutti | 132/308 |
| 5,511,277 | A | | 4/1996 | Simonds | 15/167.1 |

FOREIGN PATENT DOCUMENTS

| | | | | |
|---|---|---|---|---|
| DE | 34 25 940 | | 1/1986 | |
| EP | 0 173 150 | | 3/1986 | |
| FR | 912722 | * | 5/1946 | 15/167.1 |
| GB | 202540 | * | 8/1923 | 15/144.1 |
| GB | 2 299 264 | | 10/1996 | |
| WO | WO 95/01113 | | 1/1995 | |
| WO | WO 95/12333 | | 5/1995 | |

* cited by examiner

*Primary Examiner*—Gary K. Graham
(74) *Attorney, Agent, or Firm*—Nora Stein-Fernandez; Stephen A. Venetianer; Charles M. Kinzig

(57) ABSTRACT

The invention concerns a toothbrush with a bristle head or accessory unit which compensates for the brushing pressure and associated bending of the holder unit as well as hand movements. The toothbrush is characterized in that an O-ring or elastic shoe that is made either detached from or connected to the adjacent components is provided between the replaceable or fixed bristle unit and the holder unit. The bristle unit and holder unit are joined via a ball joint.

20 Claims, 16 Drawing Sheets

TOOTH BRUSH WITH ELASTICALLY ARTICULATED REPLACEABLE HEAD

BACKGROUND OF THE INVENTION

The invention relates to a tooth brush which consists of a bristle part which can be exchanged when required and a holder with special additional functions.

EP-A-0 173 50 describes an electrical tooth brush having a brush head which can be driven in a circular motion. The brush head is releasably secured to the drive and tiltably mounted.

A tooth brush with a twice angled handle and a bristle head is known from WO-A-95/12333. The bristle head, which either forms a separate component or is united in one piece with the handle is tiltable about an axis which stands perpendicular both to the longitudinal direction of the handle and also to the direction in which the bristles of the bristle head extend.

WO-A-95/12333 discloses a tooth brush with a handle and a movable bristle head. The bristle head can be latched to the handle by means of connection means in such a way that is freely rotatable both in and opposite to the clockwise sense and can also simultaneously oscillate about an axis extending perpendicular to the handle. The connection means comprise a pin which has a ring-like formation at its end face or a mushroom-like spigot.

Exchangeable bristle parts are known in many rigid embodiments in the trade and, amongst other things, through the German patent 44 22 073.8 C1.

Furthermore, there are tooth brushes with a flexibly hinged kinked handle. These are known in the documents EP 0 613 636 A1, EP 0 251 705 B1, EP 0 462 509A1, EP 0 336 641 and EP 0 371 293 and EP 0 648 448; A1.

All the tooth brushes listed here have more or less the same problem. The bristle head deflects away from the active surface at the human set of teeth as a result of the bending moment. The consequence is that the bristles arranged towards the center of the holder receive more pressure one-sidedly and uncontrollably. The cleaning action for the rear molars is less due to lack of contact pressure. The bristles at the center of the holder in contrast receive too much pressure and injure the gum and wear the tooth enamel more than is necessary.

Some embodiments of EP 0 613 636 A1 admittedly have improved possibilities through elastomeric hinging. A desired contact is, however, not hereby possible. An environmentally friendly exchange of the bristle head is not shown here.

The present invention shows possibilities for the exchangeability of the bristle head with value being placed on an environmentally friendly possibility of material separation. The pivotal deflection and resilient deflection can be changed by an elastic connecting member, which is manufactured separately from the exchangeable bristle part.

A labeling possibility, a design as a travel tooth brush, the mounting of the exchangeable accessory in the holder and the brush as a depot are shown.

Labeling possibilities with. adhesively attachable name labels presents the trade with a large problem of availability, in particular when the customer not only wishes to select his name but also his own color (see EP 0 114 41).

In accordance with the invention the bristle is proposed as a depot carrier for solid substances which can fight fungi, bacteria and germs, but which can also be a carrier for minerals and trace elements, such as, for example, fluoride and calcium. In addition, it is explained how the bristle part can be removed again when worn without one being able to break a fingernail.

Particularly advantageous embodiments of the invention are characterized in the independent claims.

BRIEF DESCRIPTION OF THE DRAWINGS

The following description will serve, with reference to the accompanying drawings, for the purpose of the illustration and of the classification of the invention.

DESCRIPTION OF THE PREFERRED EMBODIMENTS

Figure 1A:
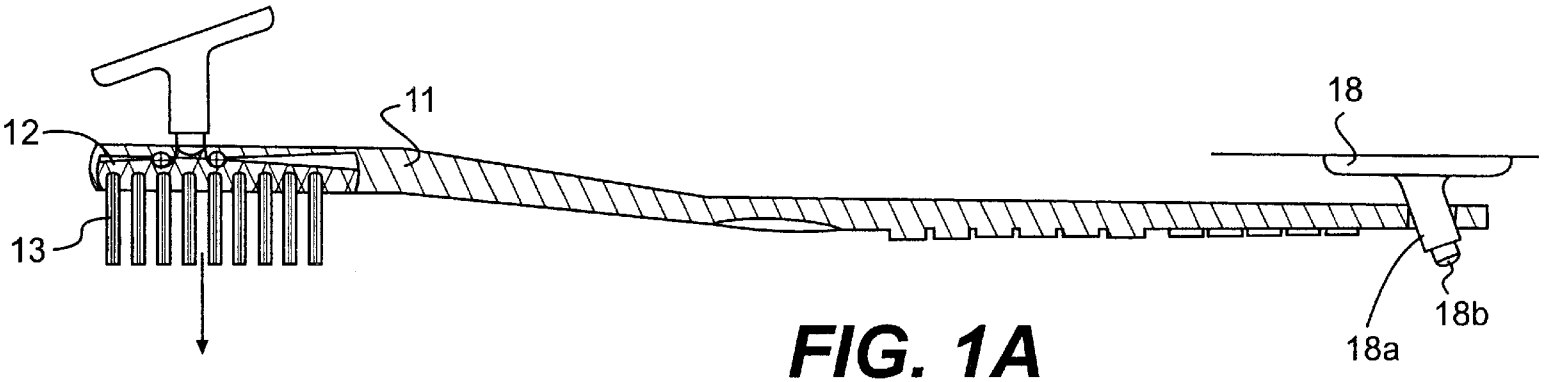
FIG. 1A longitudinal section of the tooth brush with exchangeable bristle part FIG. 1B compensatory action of the tooth brush with cleaning pressure at the set of teeth FIG. 1C transverse section with compensatory action of the tooth brush with cleaning pressure at the set of teeth FIG. 1D partial enlargement of FIG. 1A at the front FIG. 1E bottom view of the tooth brush with the exchangeable bristle part FIG. 1F perspective view of the exchangeable bristle part FIG. 2A longitudinal section of the tooth brush with exchangeable bristle part FIG. 2B compensatory action of the tooth brush with cleaning pressure at the set of teeth FIG. 2C transverse section with compensatory action of the tooth brush with cleaning pressure at the set of teeth FIG. 2D partial enlargement of FIG. 2A at the front FIG. 2E perspective view of an elastic shoe as a connecting member FIG. 2F bottom view of the tooth brush with the exchangeable bristle part FIG. 3A longitudinal section of a travel tooth brush with exchangeable bristle parts ready for use FIG. 3B bottom view of a travel tooth brush with exchangeable bristle part hygienically stored FIG. 3C longitudinal section of a travel tooth brush with an exchangeable bristle head hygienically stored FIG. 3D bottom view of a travel tooth brush with an exchangeable bristle part ready for use FIG. 4A longitudinal section of a tooth brush with a fixed bristle part FIG. 4B compensatory action of the tooth brush with cleaning pressure at the set of teeth FIG. 4C transverse section with compensatory action of the tooth brush with cleaning pressure at the set of teeth FIG. 4D bottom view of the tooth brush with the fixed bristle part FIG. 5A longitudinal section of the tooth brush with the fixed bristle part FIG. 5B compensatory action of the tooth brush with cleaning pressure at the set of teeth FIG. 5C transverse section with compensatory action of the tooth brush with cleaning pressure at the set of teeth FIG. 5D bottom view of the tooth brush with the fixed bristle part FIG. 6 longitudinal section of a holder with an elastically suspended accessory FIG. 7 longitudinal section of a holder with a rigidly suspended tooth plaque scraper FIG. 8 script representation with eleven segment representation, for example letters M and U FIG. 9 bristle tuft with bristle as a carrier for active substance in the form of a tube with holes FIG. 10 bristle tuft with a bristle as a carrier for active substance in the form of a tube with longitudinal opening FIG. 11 bristle tuft with bristle as a carrier for active material in small cavities FIG. 12 bristle tuft with bristle as a carrier for active substance in the form of a stranded arrangement of fine active material bristles and fine bristles.
Figure 1B:
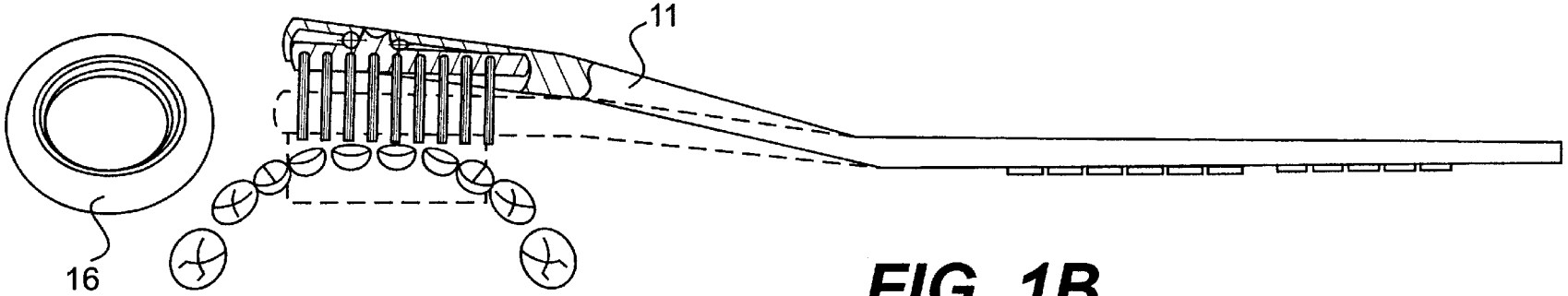
Figure 1C:
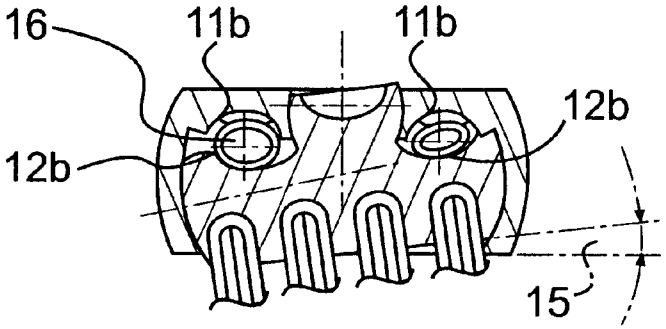
Figure 1D:
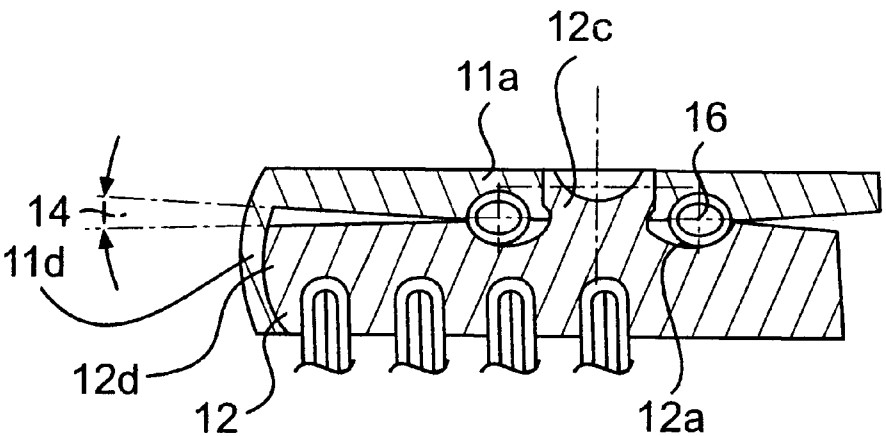
Figure 1E:
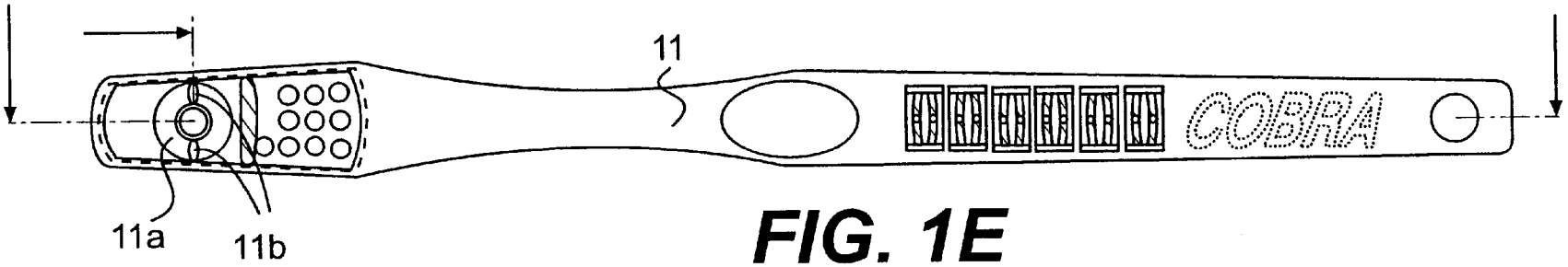
Figure 1F:
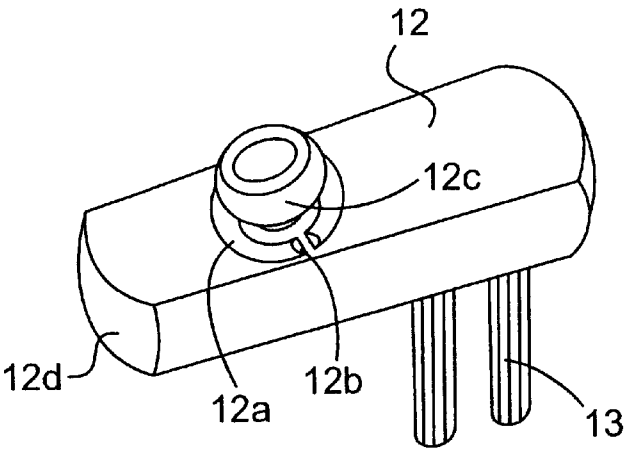

FIG. 1A shows a longitudinal section through a tooth brush with a ball joint 12*c*. FIG. 1C, FIG. 1D Between the exchangeable bristle part 12 and the holder 11 lies an O-ring in a ring-like cutout 11*a* and 12*a*. The spacing of the ball joint 12*c* in the longitudinal direction is preferably displaced in the longitudinal direction out of the center of gravity of the bristle part 12 in order to achieve a compensatory movement for the bending deflection of the holder. It the longitudinal direction the pivot angle 14 is restricted by fixed abutment and in the transverse direction the pivot angle 15 is restricted by fixed abutment.

In order to achieve different spring rates with a simple O-ring with preferably the same cross-section and hardness, noses 11*b* and 12*b* are mounted in the transverse direction. If O-rings 16 of different Shore hardness are enclosed in the sales package, the customer can vary the hardness as desired. For this purpose the O-rings can be differently colored. The wall holder in FIG. 1A serves through the front projection 18*b* for the pressing of the used bristle part 12 out of the holder 11. In this arrangement the projection 18*a* serves as an abutment for the protection of the holder 11 or 21. The outer peripheral edge of the bristle part 12*d* sits accurately fitted in spherical manner in the opening 11*d*, so that no toothpaste contaminations can disturb the mobility during the tilting movement.

Figure 2A:
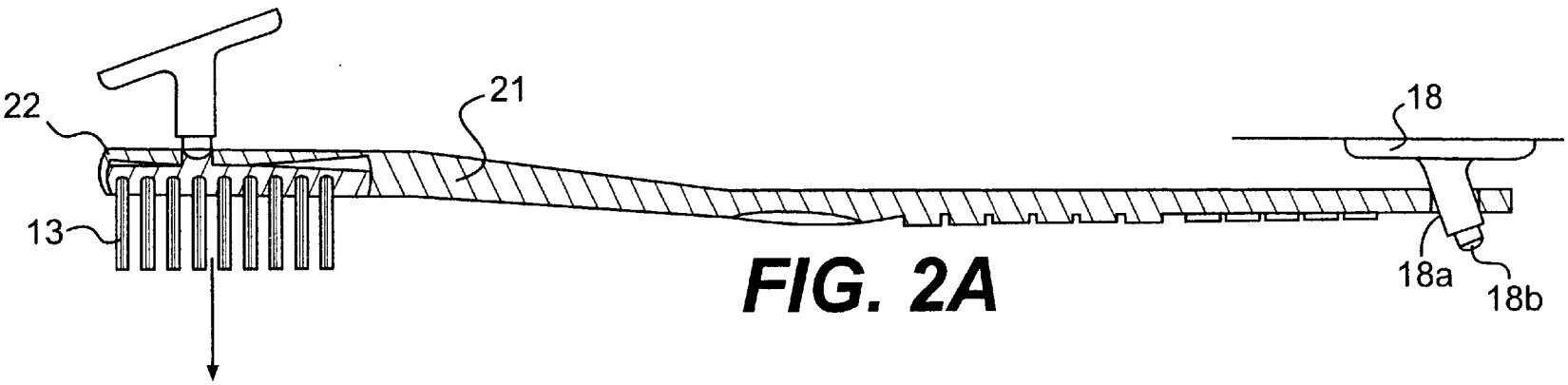
Figure 2B:
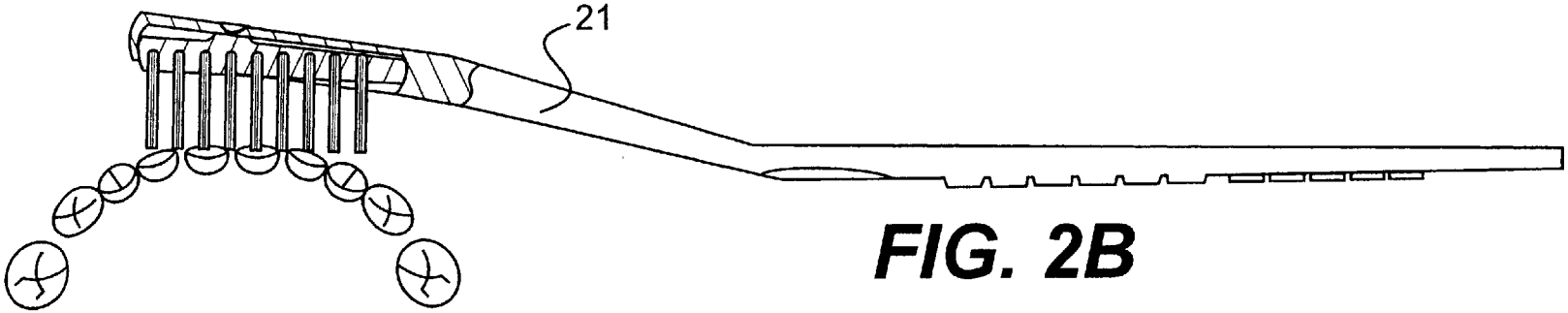
Figure 2C:
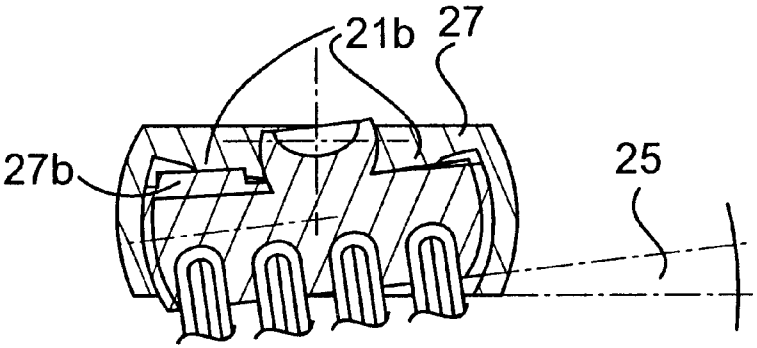
Figure 2D:
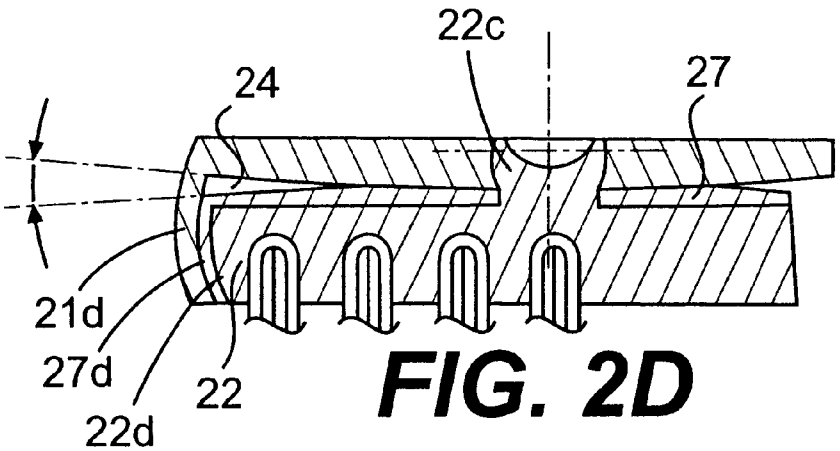
Figure 2E:
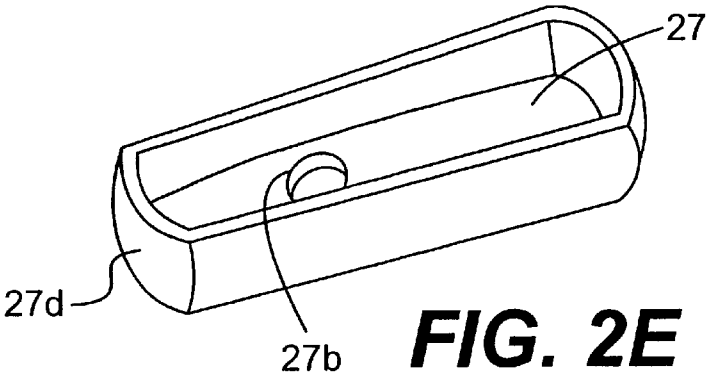
Figure 2F:
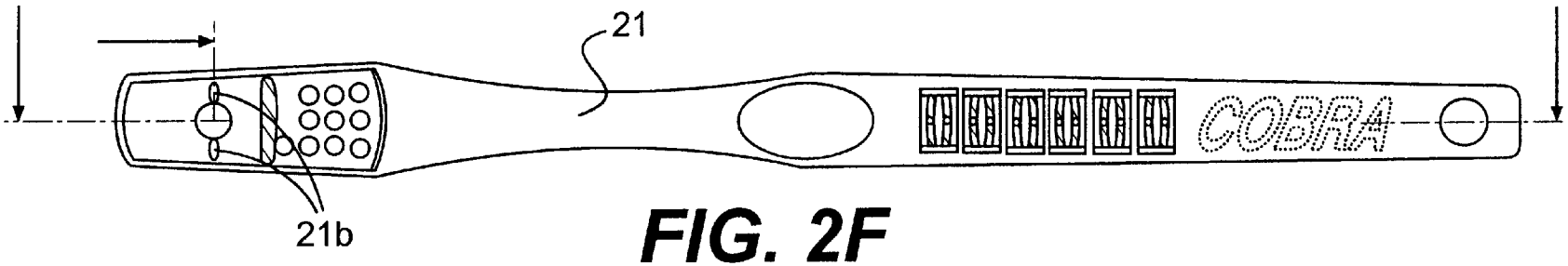

The embodiment of FIG. 2A, FIG. 2C, FIG. 2D and FIG. 2E, in which an elastic shoe 27 simultaneously ensures a sealing towards the outside, is better protected against the problem of contamination. FIG. 2B again shows the compensatory action with the cleaning pressure.

In order to achieve different spring rates for the same hardness, noses 21*b* are provided on the holder in the transverse direction, and noses 27*b* are provided on the shoe. If shoes 27 of different Shore hardnesses are enclosed in the sales package, the customer can change the hardness as desired. The shoes can be differently colored for this purpose. It is also possible to dispense with the noses in the bristle part, as shown. Many variants are possible here and could not all be shown here.

Figure 3A:
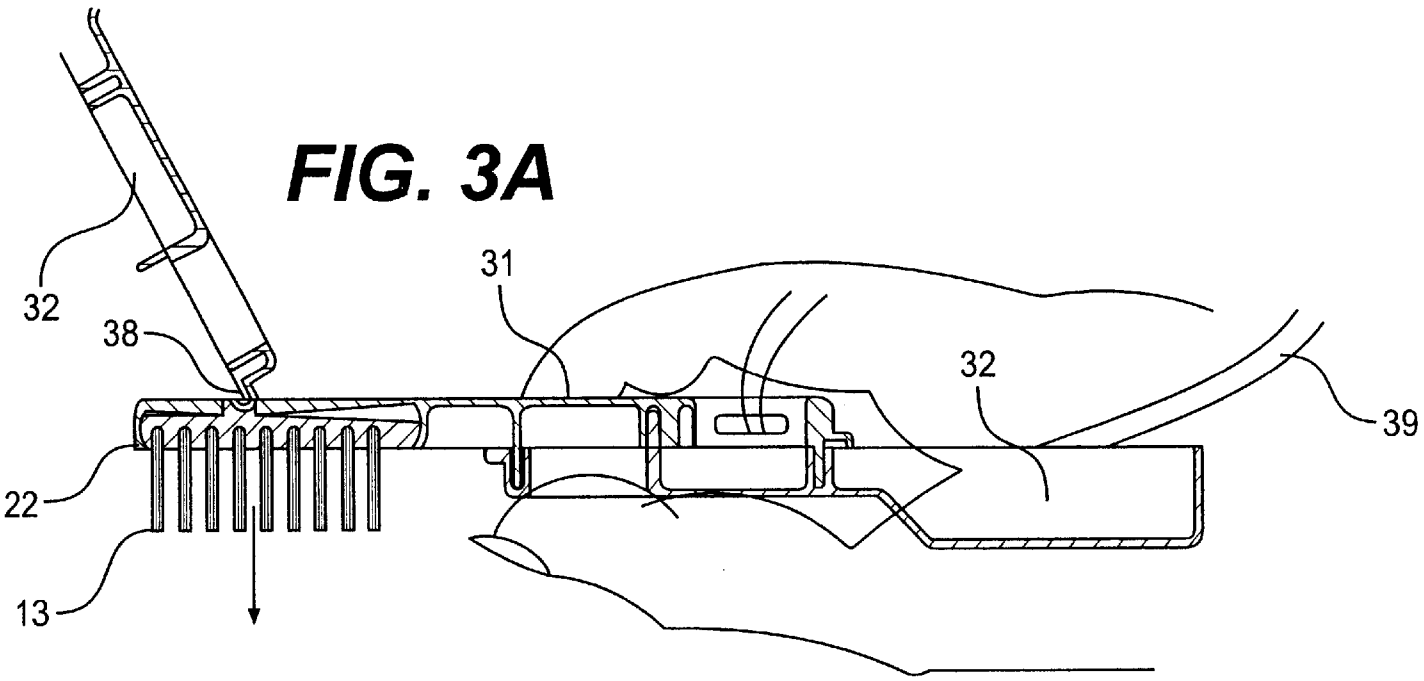
Figure 3D:
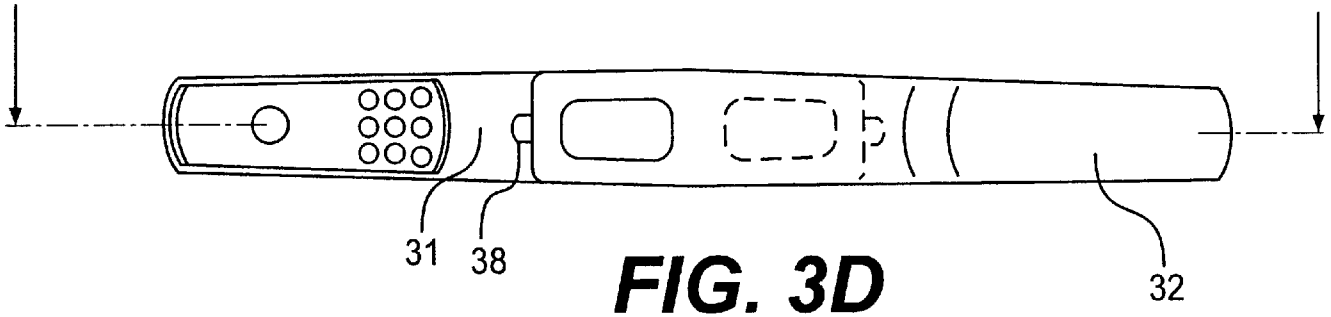
Figure 3B:
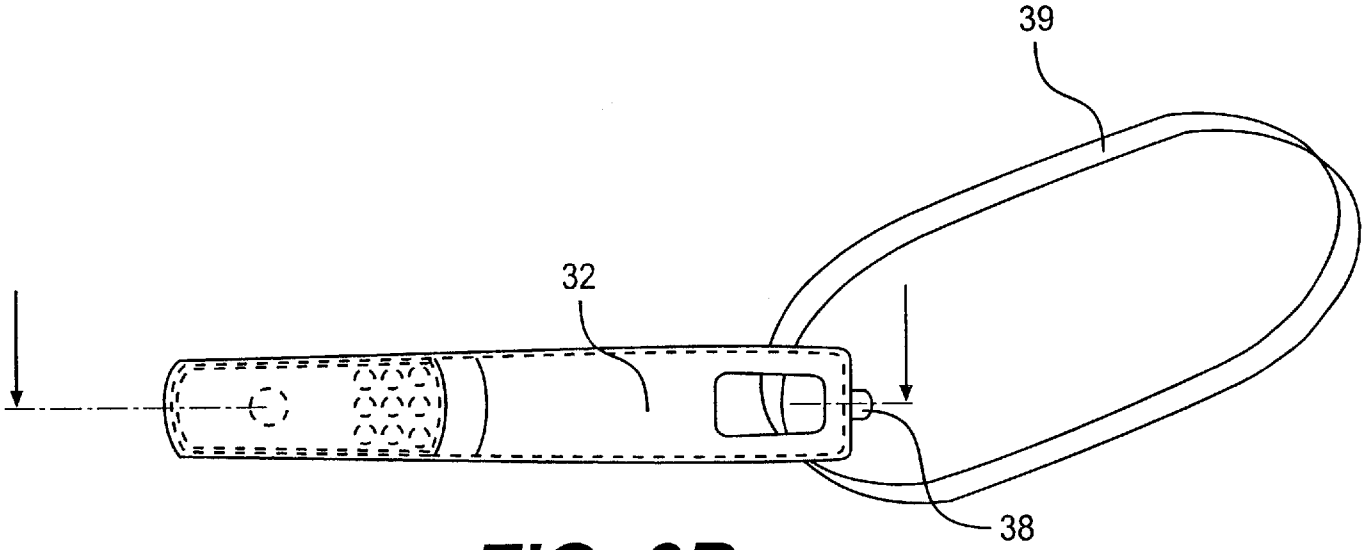
Figure 3C:
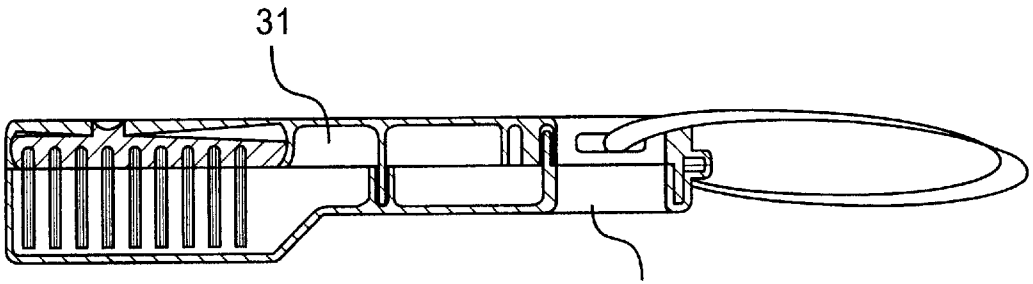

FIG. 3A, FIG. 3D show a travel tooth brush ready for use when the handle part 32 turned through 180° is mounted onto the holder part 31. A loop 39 prevents the loss of the brush. The handle part 32 simultaneously serves as an ejector for the used bristle part 22 (or also the embodiment 12). FIG. 3B, FIG. 3C show the hygienically stored bristle part 22 in the travel state.

Figure 4A:
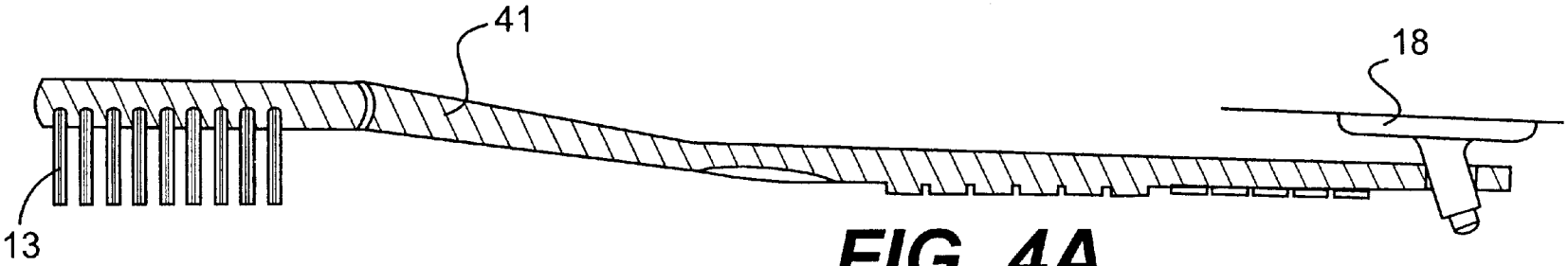
Figure 4B:
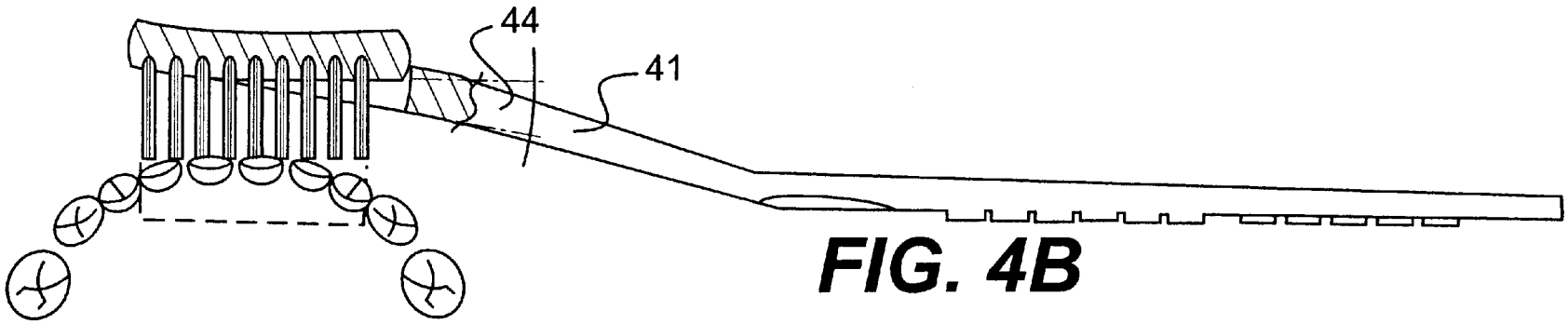

FIG. 4A shows a longitudinal section through a tooth brush with an elastically connected firm connection, which is preferably displaced in the longitudinal direction in the direction of the bristle part out of the center of gravity of the bristle part in order to achieve a compensatory movement for the bending deflection of the holder.

Figure 4C:
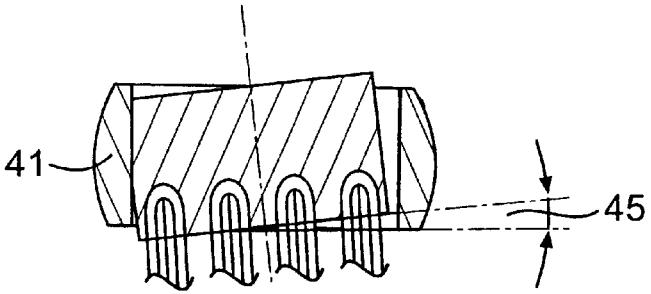
Figure 4D:
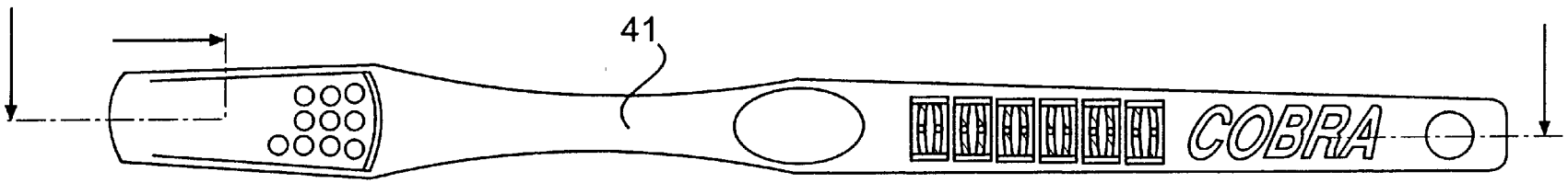

FIG. 4C In the longitudinal direction the pivot angle 44 is restricted by fixed abutment, and in the transverse direction, the pivot angle 45 is restricted by fixed abutment.

Figure 5A:
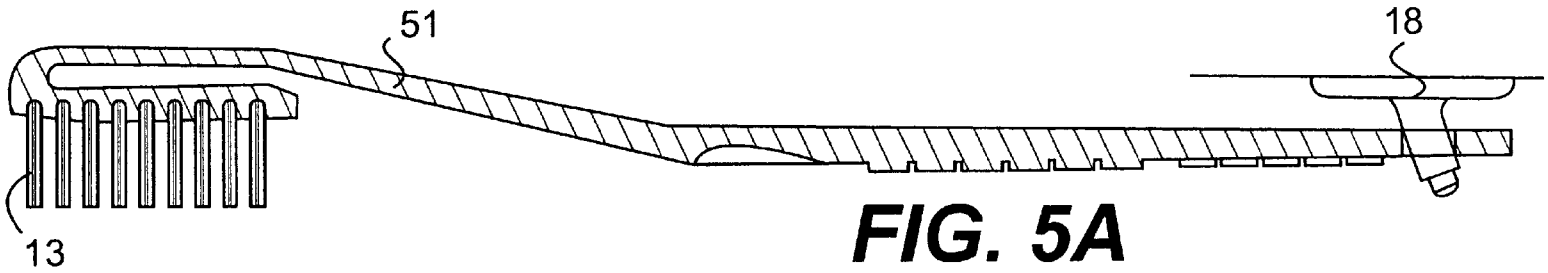
Figure 5B:
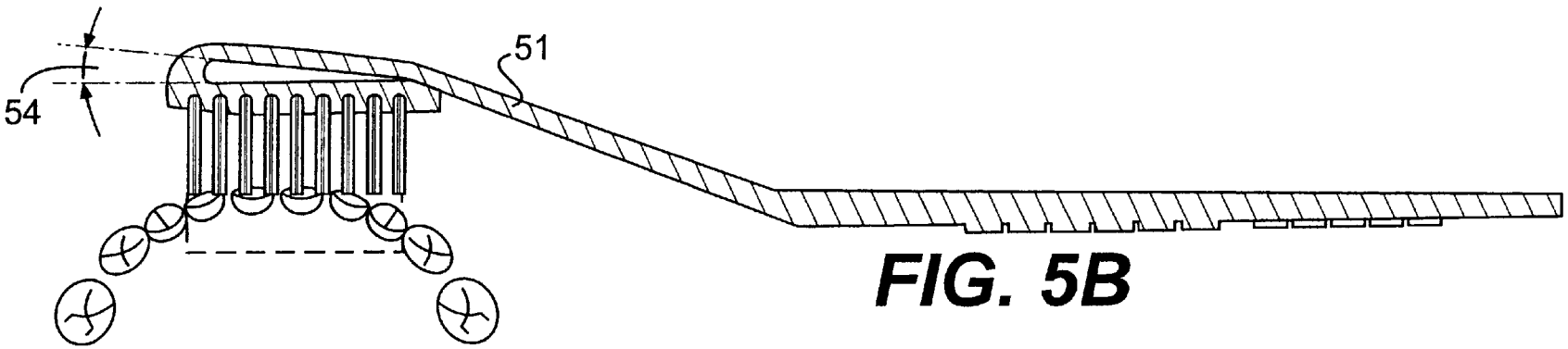

FIG. 5A Longitudinal section through a tooth brush with elastically connected bristle part connection as a variation of 4, preferably firm connection offset in the longitudinal direction out of the center of gravity of the bristle part in the direction of the bristle part in order to achieve a compensatory movement for the bending deflection of the holder.

Figure 5C:
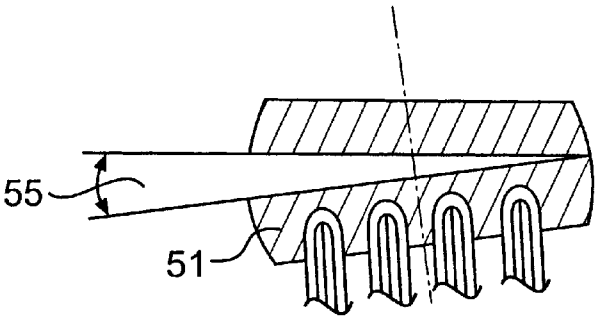
Figure 5D:
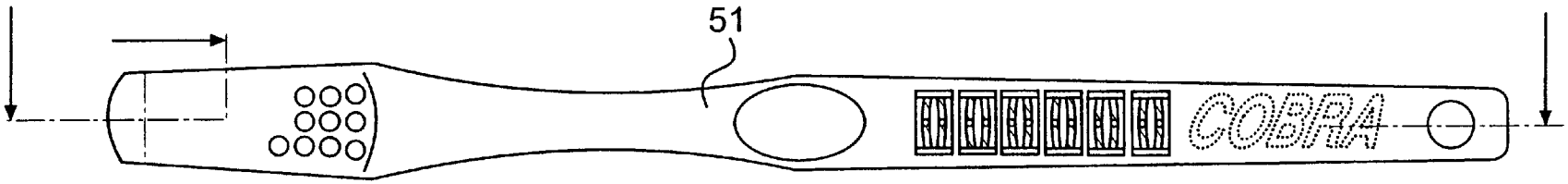
Figure 6:
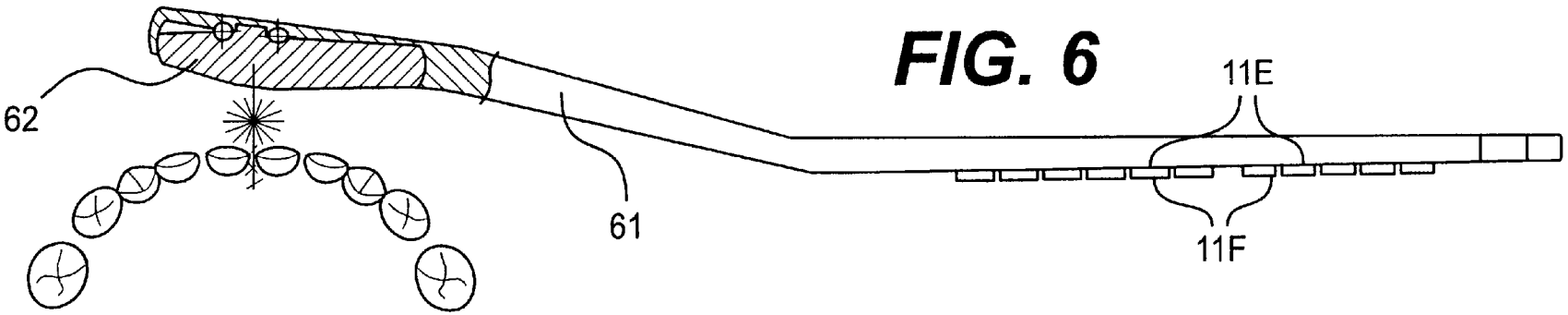

FIG. 5C Similar to 4C in the longitudinal direction the pivot angle 54 is restricted by fixed abutment, and in the transverse direction the pivot angle 55 is restricted by fixed abutment FIG. 6 Here the advantages of an elastically suspended accessory part are shown, in this case an interspace brush. The possibility of articulation self-evidently leads to large cleaning success here.

Figure 7:
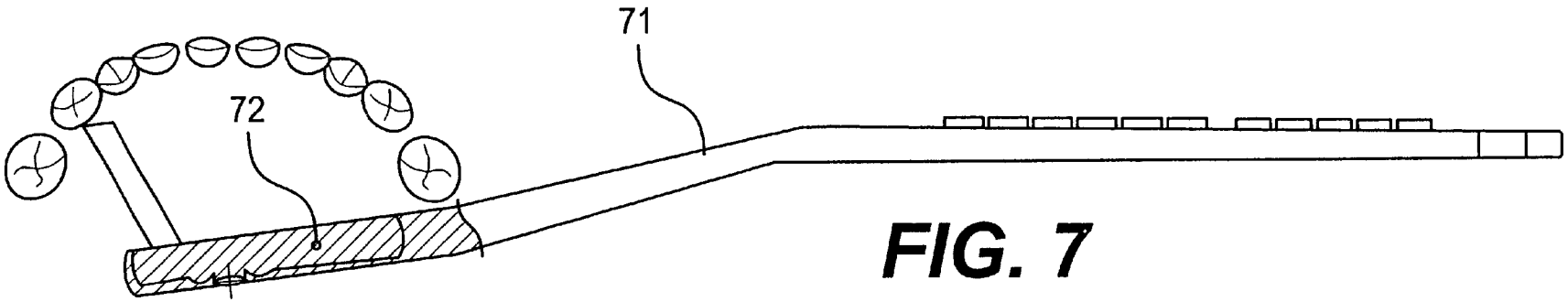

FIG. 7 In contrast to this, a scraper, for example for plaque, must be rigidly mounted. Here the intermediate space of the elastic part 16 or 27 is taken up by the material of the scraper part.

Figure 8:
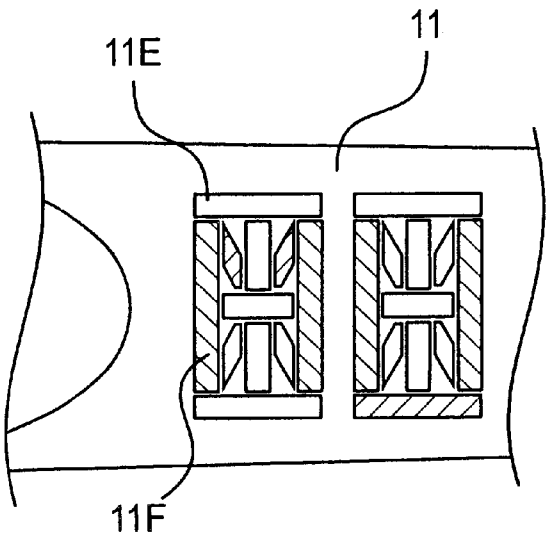

FIG. 8 A very simple written labeling with an 11 segment representation is shown for the example of the letters M and U of the elements 11*f* etc. and enables the customer to individually label at home by scratching off the corresponding mark segments 11*e* etc. Additional costs during manufacture do not arise when the name of the manufacturer (here COBRA, no claim to registered trademark) is printed simultaneously with the eleven-segment.

Figure 9:
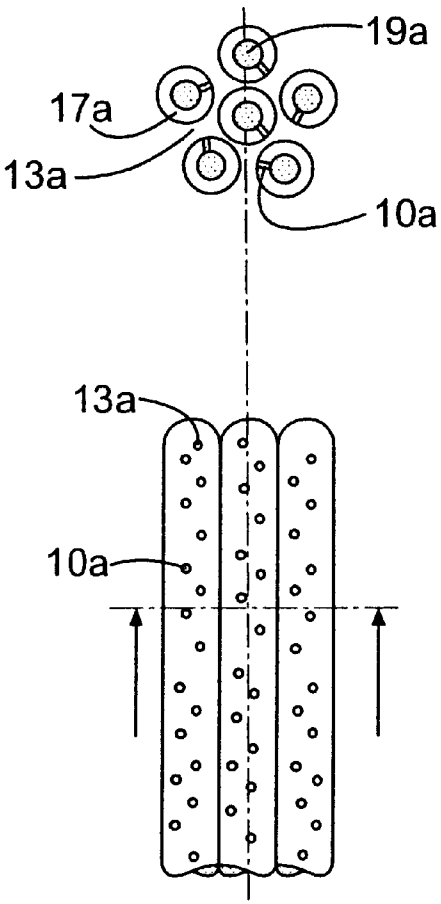

FIG. 9 Here the bristle becomes a carrier for the active substance in the form of a tube with holes. With an appropriately selected carrier substance active substance can be intentionally washed out of these holes in order, for example, to kill off fungi, bacteria or germs or to introduce minerals and trace elements into the tooth, the gum or the mouth cavity.

Figure 10:
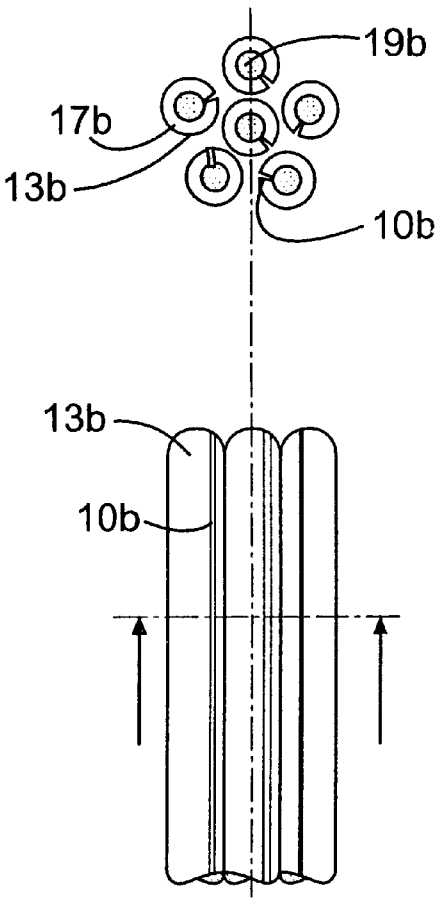

FIG. 10 Bristle tuft with bristles as a carrier for active substance in the form of a tube with longitudinal opening.

Figure 11:
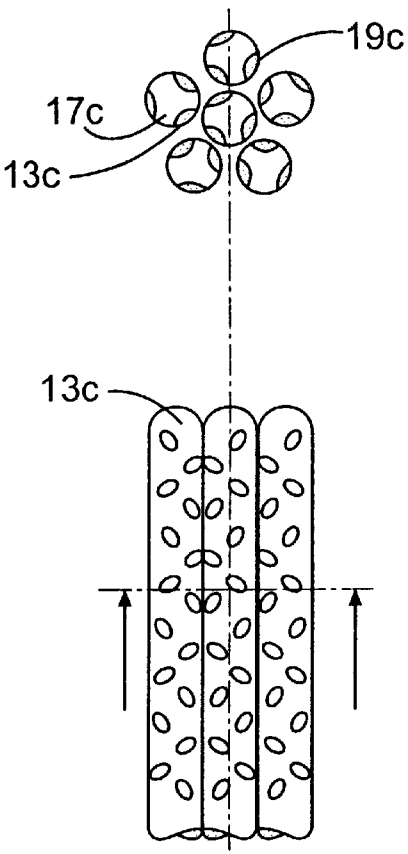

FIG. 11 Bristle tuft with bristle as carrier for active substance in small cavities.

Figure 12:
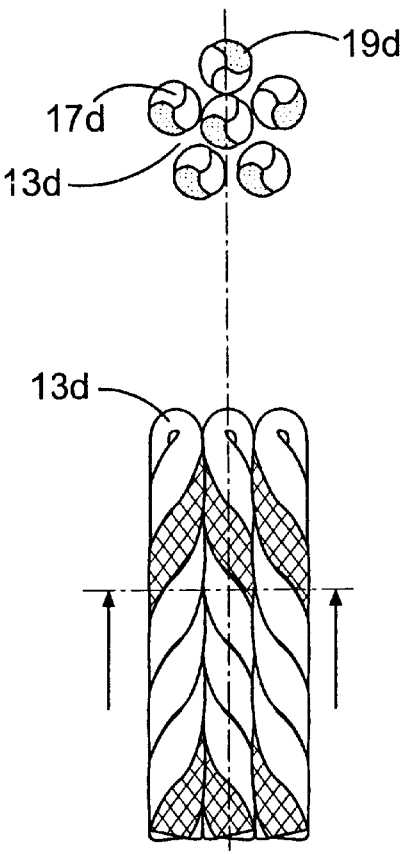

FIG. 12 Bristle tuft with a bristle as a carrier for active substance in the form of a stranded arrangement of fine bristles of active material and fine bristles.

What is claimed is:

1. A toothbrush having a holder (11, 21) and having a bristle part (12, 22) and a ball joint (12*c*, 22*c*) between and pivotally connecting the holder and bristle part, wherein the bristle part is pivotable through a pivot angle with respect to the holder by means of the ball joint (12*c*, 22*c*) and wherein an elastic O-ring (16), which surrounds the ball joint (12, 22*c*) is provided between the holder and the bristle part with a cutout (11*a*, 12*a*) shaped to correspond with said O-ring (16) and to receive said O-ring (16) being formed between the holder and the bristle part.

2. The toothbrush in accordance with claim 1, wherein the O-ring (16) is formed as a separate component.

3. The toothbrush in accordance with claim 1, wherein the O-ring (16) is part of the holder.

4. The toothbrush in accordance with claim 1, wherein, to achieve different spring rates, ribs (11*b*, 12*b*, 21*b*, 27*b*) are provided in the holder (11, 21), with the ribs being arranged in the transverse direction with respect of the holder.

5. The toothbrush in accordance with claim 1, wherein the ball joint (12*c*, 22*c*) forms a releasable clip connection between the holder and the bristle part, allowing the bristle part to be replaceably removed from the holder.

6. The toothbrush in accordance with claim 1, formed as a travel toothbrush in which the holder has a holder part (31) and a handle part (32) separate from it, with the handle part having a spherical projection (38), by which the bristle part can be ejected from the holder part (31).

7. The toothbrush in accordance with claim 1, wherein, for formation of the ball joint the holder has a substantially round opening and the bristle part has a spigot (12, 22*c*), which has a jacket surface the shape of a part of a spherical surface.

8. The toothbrush in accordance with claim 7, wherein the ball joint is designed in such a way that with a pressure directed in the direction of the holder onto the bristle part, which corresponds to a specific limiting cleaning pressure, the spigot (12*c*, 22*c*) is caused to move through the opening of the holder beyond the surface of the holder remote from the bristle part.

9. The toothbrush in accordance with claim 1, wherein at least one fixed abutment is provided in order to limit the pivot angle (14, 24) of the bristle part in the longitudinal direction relative to the holder.

10. The toothbrush in accordance with claim 1, wherein the holder has a segmented script representation, having a plurality of mark segments, which can be scratched away segment-wise for individual labelling of the toothbrush, and with the segmented script representation having at least one eleven segment element being applied for cost favourable manufacture to the same side as a manufacturer or product marking.

11. The toothbrush in accordance with claim 1, with bristles, wherein at least some of the bristles (17*a*, 17*b*, 17*c*, 17*d*) have an active substance (19*a*, 19*b*, 19*c*, 19*d*) which can be washed out, which comprises fungi, bacteria or germ killing substance, minerals or trace elements.

12. The toothbrush in accordance with claim 11, wherein the bristles (17*a*) each have the form of a tube closed off at an end face and having holes (10*a*) with the active substance (19*a*) being arranged within the tube and being capable of being washed out through the holes (10*a*).

13. The toothbrush in accordance with claim 11, wherein the bristles (17*b*) each have the form of a tube closed off at an end face and having a longitudinal opening (10*b*) with the active substance (19*b*) being arranged within the tube and being capable of being washed out through the longitudinal opening.

14. The toothbrush in accordance with claim 11, wherein the bristles (17*c*) each have a plurality of recesses, in which the active substance (19*c*) is arranged.

15. The toothbrush in accordance with claim 11, having bristle tufts (13*d*), which are formed as stranded bristles (17*d*), which contain active substance, and bristles (19*d*), which contain no active substance.

16. The toothbrush in accordance with claim 1, wherein the O-ring (16) is part of the bristle part.

17. The toothbrush in accordance with claim 1, wherein, to achieve different spring rates, ribs (11*b*, 12*b*, 21*b*, 27*b*) are provided in the bristle part (12, 22) with the ribs being arranged in the transverse direction with respect to the holder.

18. The toothbrush in accordance with claim 1, wherein at least one fixed abutment is provided in order to limit the pivot angle (15, 25) of the bristle part in the transverse direction relative to the holder.

19. A kit comprising a toothbrush having a holder (11, 21), a bristle part (12, 22) and also an accessory part (22), in which the bristle part or the accessory part is optionally securable to the holder by means of a ball joint (12*c*, 22*c*) forming a releasable clip connection, characterized in that on attaching the bristle part to the holder the bristle part is pivotable through a pivot angle with respect to the holder and in that the accessory part is designed such that, on fastening it to the holder, it fills out an intermediate space provided at the holder for the pivotal movement of the bristle part, so that the holder and the accessory part secured thereto form a substantially rigid connection, which does not enable a pivotal movement of the accessory part.

20. A kit comprising:

a tooth brush having a holder (11, 21) and having a bristle part (12, 22) and a ball joint (12*c*, 22*c*) between and pivotally connecting the holder and bristle part, and wherein the bristle part is pivotable through a pivot angle with respect to the holder by means of a ball joint (12*c*, 22*c*), and having a cutout (11*a*, 12*a*) between the holder and the bristle part to receive an O-ring, and multiple O-rings (16) of respectively different hardness, any one of which may be selected and positioned in said cutout and when so positioned may be subsequently removed and replaced with another of said O-rings.

* * * * *